United States Patent [19]

Moeller

[11] Patent Number: 4,883,229

[45] Date of Patent: Nov. 28, 1989

[54] RETROFIT REFUELING APPARATUS FOR AN OVERHEAD FUEL MANIFOLD

[76] Inventor: Arnold T. Moeller, 3565 Dorothy La., South, Fort Worth, Tex. 7610

[21] Appl. No.: 258,123

[22] Filed: Oct. 11, 1988

Related U.S. Application Data

[63] Continuation of Ser. No. 84,282, Aug. 11, 1987, abandoned.

[51] Int. Cl.[4] ..... F17D 1/00; B65B 3/04

[52] U.S. Cl. ..... 239/587; 141/389; 137/615

[58] Field of Search ..... 239/195, 281, 750, 763, 239/587; 137/615; 141/289, 387–389

[56] References Cited

U.S. PATENT DOCUMENTS

| | | | |
|---|---|---|---|
| 2,722,230 | 11/1955 | Toussaint | 137/615 X |
| 2,957,489 | 10/1960 | Fisher | 137/615 X |
| 3,021,867 | 2/1962 | Gallagher | 137/615 X |
| 3,038,714 | 6/1962 | Klaus et al. | 267/154 |
| 3,114,392 | 12/1963 | Harper | 137/615 |
| 3,587,643 | 6/1971 | Bahr | 137/615 |
| 4,111,465 | 9/1978 | Knight | 137/615 |
| 4,202,372 | 5/1980 | Gibbons | 141/387 X |
| 4,537,233 | 9/1985 | Vroonland et al. | 141/387 |
| 4,658,873 | 4/1987 | Von Meyerink et al. | 141/387 |
| 4,658,874 | 4/1987 | Von Meyerink et al. | 141/387 |

*Primary Examiner*—Robert J. Oberleitner
*Assistant Examiner*—Kevin P. Weldon
*Attorney, Agent, or Firm*—Charles D. Gunter, Jr.

[57] ABSTRACT

A retrofit refueling apparatus is shown for use with an overhead fuel manifold of the type used to supply fuel to a locomotive fuel tank. The refueling apparatus includes a movable carriage and a conduit which joins the movable carriage to the primary flow valve of the overhead fuel manifold. A rigid refueling arm communicates with the conduit and runs from the movable carriage to a refueling nozzle. The rigid refueling arm is spring-loaded to a positive angular orientation above the plane of the surrounding substrate.

2 Claims, 3 Drawing Sheets

RETROFIT REFUELING APPARATUS FOR AN OVERHEAD FUEL MANIFOLD

This application is a continuation, of application Ser. No. 084,282, filed 08/11/87, now abandoned.

BACKGROUND OF THE INVENTION

1. Field of the Invention

The present invention relates generally to refueling devices of the type used in refueling railroad locomotives and, specifically, to a retrofit refueling apparatus for an overheld fuel manifold of the type used to supply fuel to a locomotive fuel tank.

2. Description of the Prior Art

At the present time, railroad locomotive engines are typically refueled in station houses equipped with overhead fuel manifolds. The fuel manifold is a pipe or conduit which is supported in a horizontal plane by support posts or columns. The overhead manifold is provided with primary flow valves which extend vertically downward from the overhead manifold at regularly spaced intervals.

Each primary flow valve is connected to a flexible hose which runs from the primary flow valve to a refueling nozzle. The refueling nozzle is connected to the fuel tank of the locomotive during the refueling operation. The nozzle and hose are bulky and heavy, weighing 50 pounds or more. Handling the prior art device is thus a task which requires great strength and endurance. Because the handler can become fatigued, the chances of an accident are increased.

The present invention has as its object, the provision of a retrofit refueling apparatus for an overhead fuel manifold which can be quickly and easily installed on existing overhead fuel manifolds with a minimum of expense and effort.

The present invention also has as its object the provision of such a refueling apparatus which includes a movable carriage for supporting the weight of the fuel conduit and nozzle during use.

The present invention also has as its object the provision of a refueling apparatus which includes a rigid refueling arm which is spring-loaded to a convenient position for handling by the operator without the operator having to bear the weight of the apparatus.

Additional objects, features and advantages will be apparent in the written description which follows.

SUMMARY OF THE INVENTION

The retrofit refueling apparatus of the invention is intended for use with an overhead fuel manifold of the type used to supply fuel to a locomotive fuel tank. The overhead fuel manifold has a primary flow valve which extends downwardly from the overhead fuel manifold along a vertical axis with respect to the surrounding substrate. The refueling apparatus includes a movable carriage and a conduit which joins the movable carriage to the primary flow valve. A rigid refueling arm communicates with the conduit and runs from the movable carriage to a refueling nozzle. The rigid refueling arm is spring-loaded to a positive angular orientation above the plane of the surrounding substrate.

DESCRIPTION OF THE PREFERRED EMBODIMENT

Figure 1:
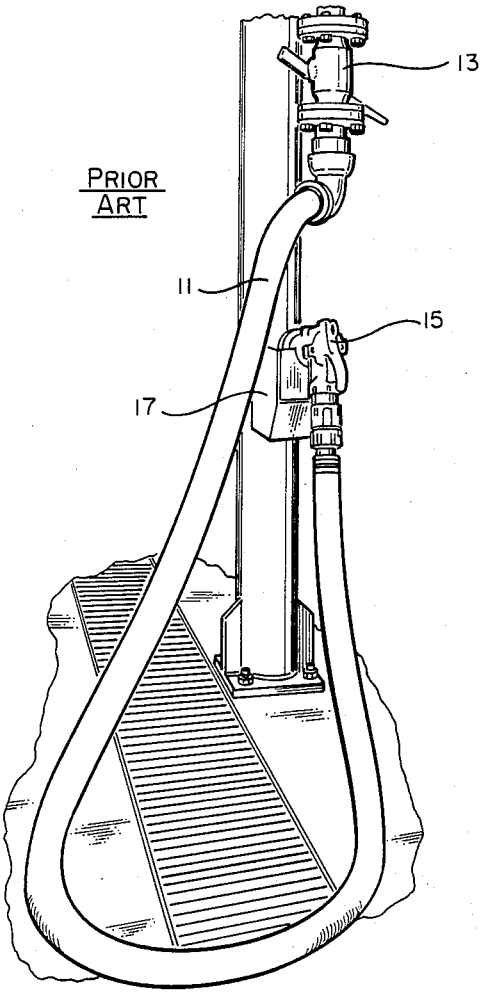
FIG. 1 is a perspective view of a prior art refueling apparatus of the type replaced by applicant's device.

FIG. 1 shows a prior art locomotive refueling device of the type intended to be replaced by the retrofit refueling apparatus of the invention. The prior art device includes a flexible hose 11 which is connected to a primary flow valve 13 at one end and which is connected to a refueling nozzle 15 at the opposite end. The nozzle 15 is shown resting in a drip pan 17.

Figure 2:
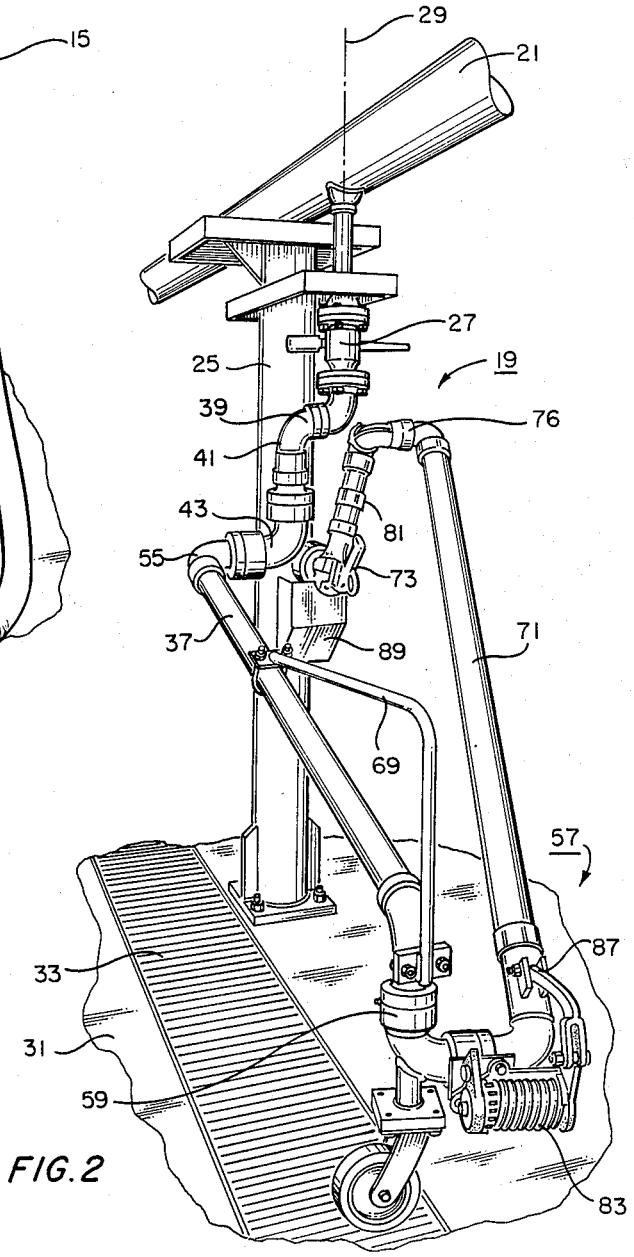
FIG. 2 is a perspective view of the refueling apparatus of the invention in the storage position.
Figure 3:
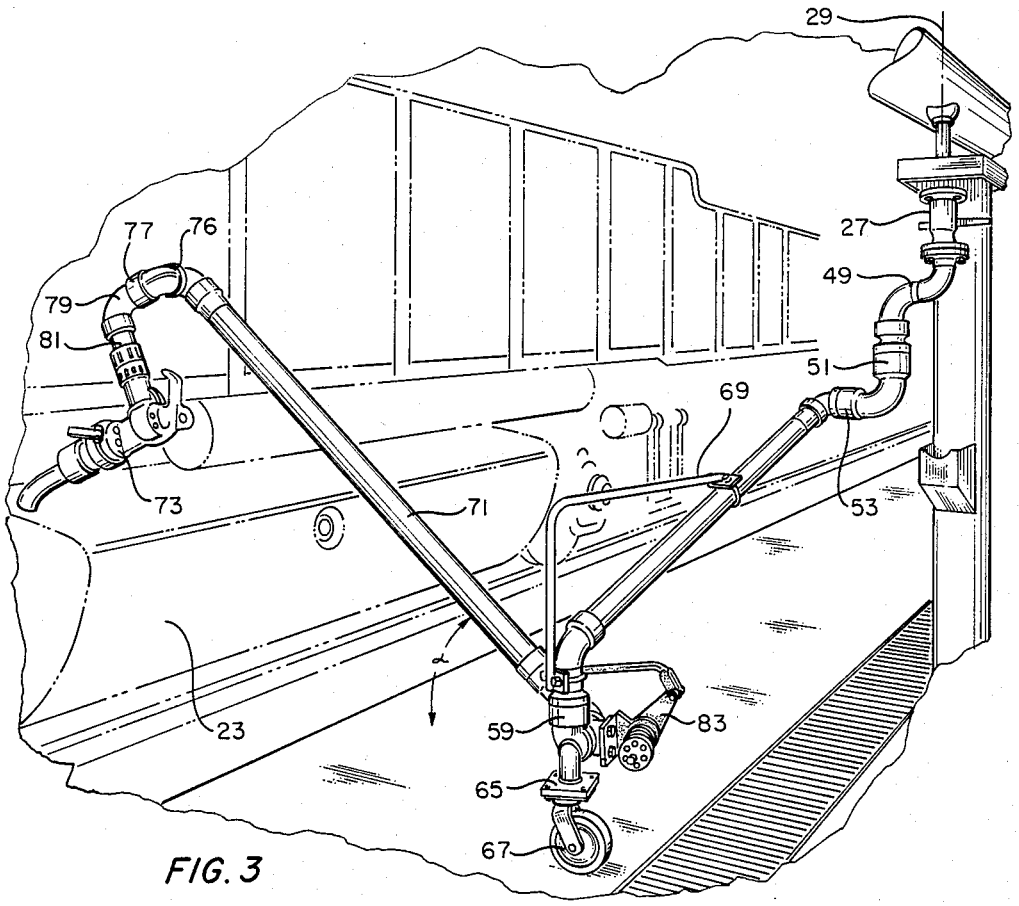
FIG. 3 is a perspective view of the refueling arm of FIG. 2, with the arm in the loading position and with the nozzle in place on a locomotive fuel tank.

FIG. 2 shows the retrofit refueling apparatus of the invention, designated generally as 19. The retrofit refueling apparatus 19 is intended to be used with an overhead fuel manifold 21 of the type used to supply fuel to a locomotive fuel tank (23 in FIG. 3). The fuel tank 23 typically holds on the order of 4,000 gallons of diesel fuel. As shown in FIG. 2, the fuel manifold 21 is supported by columns or posts 25 and is equipped with a plurality of primary flow valves 27 which extend downwardly from the overhead fuel manifold 21 along a vertical axis 29 defined with respect to the surrounding substrate, in this case concrete floor 31. The floor 31 is provided with a grate covered channel 33.

Figure 6:
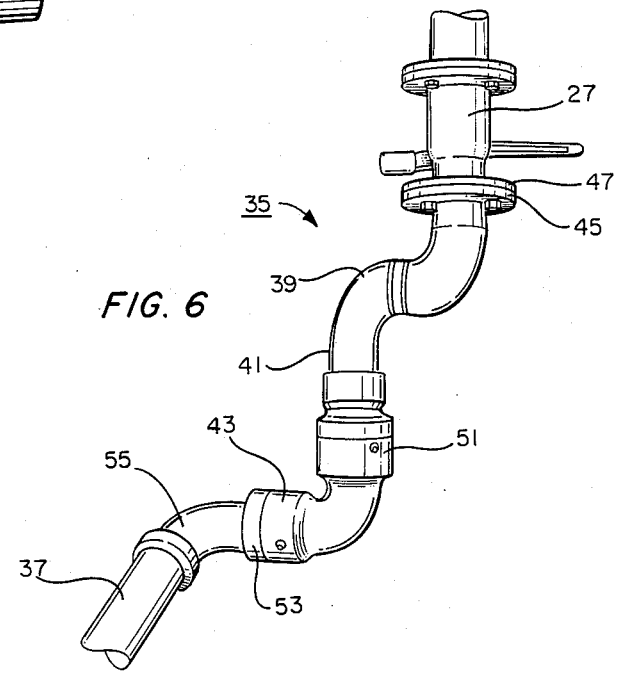
FIG. 6 is an isolated view of the primary flow valve of the overhead manifold and the connecting conduit used to join the primary flow valve to the movable carriage of the invention.

The refueling apparatus 19 includes a stair-shaped connector 35 (FIG. 6) for joining a conduit pipe 37 to the primary flow valve 27. The stair-shaped connector 35 includes a first horizontal segment 39, an intermediate vertical segment 41 and a second horizontal segment 43. The first segment 39 includes an upper extent provided with a mounting flange 45 which is bolted to a mating mounting flange 47 of the primary flow valve 27. The stair-shaped connector 35 includes swivel joints 51 and 53. Swivel joint 53 allows rotation about a horizontal plane or axis with respect to the plane of the surrounding substrate and swivel joint 51 allows rotation about a vertical plane or axis as the device is oriented in FIG. 6. Joints 51 and 53 are commercially available as a unit. Elbow 55 has been attached to the unit for connection to the conduit pipe 37. The swivel joints described are commercially available from a number of sources including EMCO Wheaton of Conneaut, Ohio as the "Style 50" and "Style 70" swing joints and from OPW division of Dover Corporation as the "basic OPW swivel joint".

The stair-shaped connector 35 presents an "offset" with respect to the vertical axis 29. The offset provided by the connector 35 serves to bring the refueling arm 71 back into the center of the work area. The offset also permits the arcuate coverage of the refueling arm to be increased since the conduit 37 will not contact the column 25.

Figure 5:
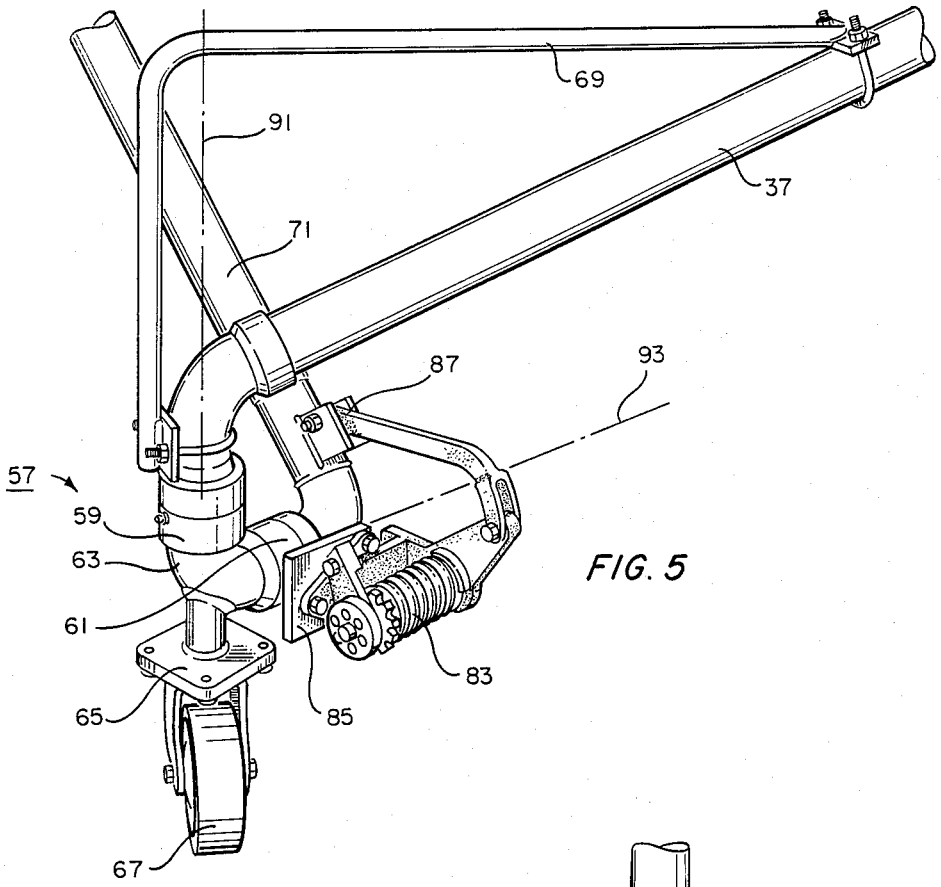
FIG. 5 is an isolated view of the movable carriage of the device of FIG. 3.

The conduit 37 is a rigid pipe running from the elbow 55 to a movable carriage 57. As best seen in FIG. 5, the movable carriage 57 includes a swivel joint 59 which provides rotation about a vertical axis 91 and a swivel joint 61 which provides rotation about a horizontal axis 93. Connecting the swivel joints 59, 61 is an elbow 63 to which is affixed a wheel support 65 and wheel 67. The wheel 67 allows the movable carriage 57 to move in an arcuate path with respect to the vertical axis 29 in FIG. 2. Preferably, the movable carriage 57 is rotatable on the wheel 67 about the vertical axis 29 of the primary flow valve 27. The wheel support 65 and wheel 67 act to reduce the load imposed upon the swivel, joints, increasing the useful life of the joints. A bracket 69 is connected to the fuel conduit 37 for use by the operator in moving the carriage 57.

Figure 4:
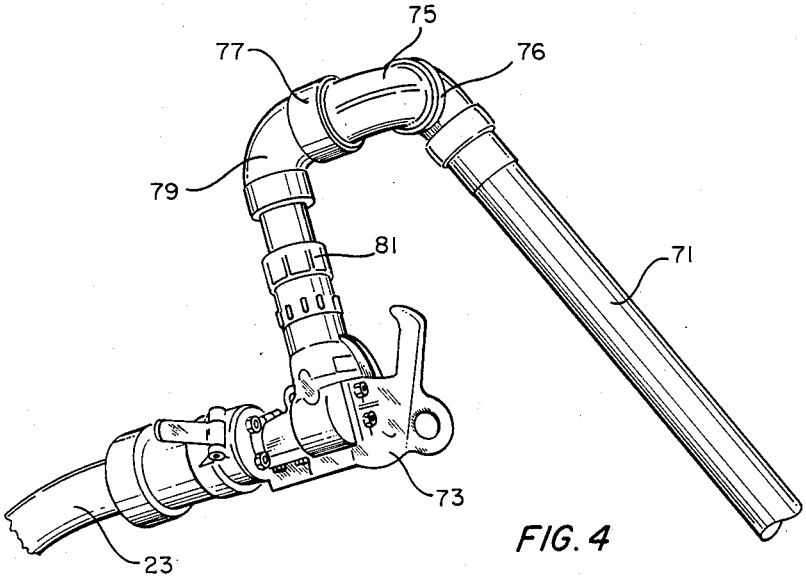
FIG. 4 is an isolated view of the refueling nozzle of the device of FIG. 3.

As shown in FIG. 5, a rigid refueling arm 71 is connected to the conduit 37 at the movable carriage 57 and runs from the movable carriage 57 to a refueling nozzle 73 (FIG. 4). The refueling nozzle 73 is commercially available from EMCO Wheaton, Inc. of Conneaut, Ohio as part no. G1630. As shown in FIG. 4, the refueling arm 71 has an elbow 75 joining swivel joints 76 and 77. An elbow 79 and connector 81 join the swivel joint 77 to the nozzle 73.

As shown in FIGS. 2 and 5, the refueling arm 71 is spring-loaded by means of a torsion spring balance 83 to a positive angular orientation above the plane of the surrounding substrate 31. This angle is illustrated as alpha in FIG. 3. As seen in FIG. 5, the torsion spring 83 is affixed by means of brackets 85, 87 to the movable carriage 57 and rigid refueling arm 71, respectfully. The spring 83 can be adjusted to vary the angle alpha but maintains the positive angular orientation of the refueling arm 71 so that the operator does not have to bear the weight of the arm 71 and nozzle 73. Torsion spring balances are commercially available from OPW Division of Dover Corporation as the OPW models 788 and 789.

In operation, the refueling apparatus of the invention can be stored in a rest position shown in FIG. 2 with the nozzle 73 being received within a drip pan 89. The operator can maneuver the refueling arm 71 to the loading position shown in FIG. 3 by rotating the loading arm 71 about the vertical axis defined by the wheel and wheel support 91 in FIG. 5. The movable carriage 57 can also be moved in an arcuate path about the vertical axis 29 defined by the primary flow valve 27. The torsion spring balance 83 allows the angular orientation of the arm 71 to be adjusted while maintaining a positive angular orientation to support the nozzle 73 above the plane of the surrounding substrate 31. The carriage and swivel joint arrangement also allow the refueling arm 71 to be swung to another locomotive arranged oppositely from and parallel to the locomotive shown in FIG. 3.

An invention has been provided with several advantages. The retrofit refueling apparatus of the invention can be quickly and easily installed on existing primary flow valves of overhead fuel manifolds. The refueling apparatus of the invention is sturdy in design and relatively inexpensive to manufacture from commercially available components. The refueling apparatus supports the weight of the refueling arm and nozzle to lessen operator fatigue and provide a safer working environment. Loading on the swivel joints is relieved to increase the useful life of the joints. The device can be manipulated to reach a variety of locations in the vicinity of the primary fuel flow valve.

While the invention has been shown in only one of its forms, it is not thus limited but is susceptible to various changes and modifications without departing from the spirit thereof.

I claim:

1. A locomotive refueling apparatus, comprising:

an overhead fuel manifold of the type used to supply fuel to a locomotive fuel tank, the overhead fuel manifold being supported in a horizontal orientation above the ground and having a primary flow valve which extends downwardly from the overhead fuel manifold along a vertical axis with respect to the ground;

a feed pipe of rigid material connected at one end to the primary flow valve by a vertical swivel joint which allows rotation in an arc about the vertical axis defined by the primary flow valve, the feed pipe having an opposite end;

a movable carriage mounted on a wheel, the carriage being connected to the opposite end of the feed pipe whereby the carriage is movable on the wheel in an arcuate path which defines a fixed orbit with respect to the vertical axis of the primary flow valve, the feed pipe forming an inclined angle greater than horizontal with respect to the ground between the movable carriage and the primary flow valve;

a refueling arm of rigid material running from the movable carriage to a refueling nozzle and communicating with the feed pipe for conveying fuel from the primary flow valve to the refueling nozzle, the refueling arm being joined to the movable carriage by an elbow coupling which includes a vertical swivel joint which allows the refueling arm to be rotated in an arc about an imaginary vertical axis defined by the wheel between a rest position and a loading position and which also includes a horizontal swivel joint;

a torsion spring means mounted on the movable carriage between the refueling arm and the carriage for spring biasing means such that the refueling arm is biased to a positive angular orientation above the plane of the ground, whereby the refueling arm is movable about the horizontal swivel joint of the movable carriage through a range of positive angular orientations and whereby the refueling arm and the feed pipe form a V-shaped configuration in both the loading position and the rest position; and wherein the movable carriage the sole point of contact with the ground between the primary flow valve and the refueling nozzle wherein the feed pipe and refueling arm together define a predetermined length of pipe between the primary flow valve at one end and the refueling nozzle at an opposite end, the movable carriage being located at the approximate midpoint of the predetermined length.

2. A locomotive refueling apparatus, comprising:

an overhead fuel manifold of the type used to supply fuel to a locomotive fuel tank, the overhead fuel manifold being supported in a horizontal orientation above the ground and having a primary flow valve which extends downwardly from the overhead fuel manifold along a vertical axis with respect to the ground;

a feed pipe of rigid material connected at one end to the primary flow valve b a vertical swivel joint which allows rotation in an arc about the vertical axis defined by the primary flow valve, the feed pipe having an opposite end;

a movable carriage mounted on a wheel, the carriage being connected to the opposite end of the feed pipe whereby the carriage is movable on the wheel in an arcuate path which defines a fixed orbit with respect to the vertical axis of the primary flow valve, the feed pipe forming an inclined angle greater than horizontal with respect to the ground between the movable carriage and the primary flow valve;

a refueling arm of rigid material running from the movable carriage to a refueling nozzle and communicating with the feed pipe for conveying fuel from the primary flow valve to the refueling nozzle, the refueling arm being joined to the movable carriage by an elbow coupling which includes a vertical swivel joint which allows the refueling arm to be rotated in an arc about an imaginary vertical axis defined by the wheel between a rest position and a loading position and which also includes a horizontal swivel joint;

a torsion spring means mounted on the movable carriage between the refueling arm and the carriage for spring biasing means such that the refueling arm is biased to a positive angular orientation above the plane of the ground, whereby the refueling arm is movable about the horizontal swivel joint of the movable carriage through a range of positive angular orientations and whereby the refueling arm and the feed pipe form a V-shaped configuration in both the loading position and the rest position; and wherein the refueling nozzle is joined to the refueling arm by an elbow which curves backwardly in the direction of the movable carriage, whereby the refueling nozzle depends downwardly from the refueling arm, the weight of the refueling nozzle being supported at the positive angular orientation by the torsion spring means at the movable carriage.

* * * * *